US008272357B2

(12) United States Patent
Lou

(10) Patent No.: US 8,272,357 B2
(45) Date of Patent: Sep. 25, 2012

(54) CROSSOVER VALVE SYSTEMS

(75) Inventor: Zheng Lou, Plymouth, MI (US)

(73) Assignee: LGD Technology, LLC, Plymouth, MI (US)

( * ) Notice: Subject to any disclaimer, the term of this patent is extended or adjusted under 35 U.S.C. 154(b) by 351 days.

(21) Appl. No.: 12/802,266

(22) Filed: Jun. 3, 2010

(65) Prior Publication Data

US 2011/0017181 A1 Jan. 27, 2011

Related U.S. Application Data

(60) Provisional application No. 61/271,607, filed on Jul. 23, 2009.

(51) Int. Cl.
*F01L 1/34* (2006.01)

(52) U.S. Cl. ..... 123/90.15; 123/70 R; 123/52.2; 123/53.5

(58) Field of Classification Search ..... 123/90.15, 123/90.16, 70 R, 52.2, 53.5
See application file for complete search history.

(56) References Cited

U.S. PATENT DOCUMENTS

| | | | | |
|---|---|---|---|---|
| 4,170,970 | A | 10/1979 | McCandless | |
| 4,253,805 | A | 3/1981 | Steinwart | |
| 6,543,225 | B2 | 4/2003 | Scuderi | |
| 6,952,923 | B2 | 10/2005 | Branyon | |
| 6,986,329 | B2 | 1/2006 | Scuderi et al. | |
| 7,421,987 | B2 | 9/2008 | Lou | |
| 7,637,234 | B2 * | 12/2009 | Tussing et al. | 123/70 R |
| 2008/0054205 | A1 | 3/2008 | Lou | |
| 2009/0038598 | A1 | 2/2009 | Phillips | |
| 2009/0038599 | A1 | 2/2009 | Tussing et al. | |
| 2009/0039300 | A1 | 2/2009 | Meldolesi et al. | |
| 2009/0044778 | A1 | 2/2009 | Scuderi et al. | |
| 2009/0133648 | A1 | 5/2009 | Lou | |
| 2010/0236534 | A1 | 9/2010 | Scuderi et al. | |

OTHER PUBLICATIONS

Scuderi Group, "Scuderi Air Hybrid Engine," a brochure distributed by Scuderi Group, LLC at SAE 2006 Congress, Detroit, Michigan, USA, on Apr. 3, 2006.

Roger Bishop, "Enter Air Hybrid," European Automotive Design, the May 2006 Issue.

Zheng David Lou, "A Dynamic Model of Automotive Air Conditioning Systems," SAE Technical Paper No. 2005-01-1884, 2005.

* cited by examiner

*Primary Examiner* — Ching Chang

(57) ABSTRACT

Crossover valve systems and corresponding methods offer an effective means to overcome large opening pressure force, or provide reasonable gas flow area, or both. In an exemplary embodiment, a crossover valve system for a split-cycle engine having a power cylinder and a crossover passage comprises first and second crossover valves, each valve opening outwardly away from the power cylinder and providing fluid communication between the power cylinder and the crossover passage, with the diameter of the second crossover valve being larger than the diameter of the first crossover valve; and an actuation mechanism operative to open the first crossover valve, then the second crossover valve after a predetermined delay to allow a certain rise in the pressure inside the power cylinder, resulting in much smaller differential pressure forces across the crossover valves, larger flow areas, or both.

15 Claims, 5 Drawing Sheets

CROSSOVER VALVE SYSTEMS

REFERENCE TO RELATED APPLICATION

This application claims priority to Provisional U.S. Patent Application No. 61/271,607, file on Jul. 23, 2009, the entire content of which are incorporated herein by reference.

FIELD OF THE INVENTION

This invention relates generally to crossover valve systems for a split-cycle engine and corresponding methods for controlling such systems, and in particular, to systems offering effective solutions to large opening differential pressure force.

BACKGROUND OF THE INVENTION

A split four-stroke cycle internal combustion engine is described in, but not limited by, U.S. Pat. Nos. 6,543,225, 6,952,923 and 6,986,329. It includes at least one power piston and a corresponding expansion or power cylinder, and at least one compression piston and a corresponding compression cylinder. The power piston reciprocates through a power stroke and an exhaust stroke of a four-stroke cycle, while the compression piston reciprocates through an intake stroke and a compression stroke. A pressure chamber or crossover passage interconnects the compression and power cylinders, with one or more crossover inlet valves providing substantially one-way gas flow from the compression cylinder to the crossover passage, and one or more crossover outlet valves providing gas flow communication between the crossover passage and the power cylinder. In this patent application, crossover valves refer only to the crossover outlet, not inlet, valves. The engine further includes intake and exhaust valves on the compression and power cylinders, respectively. According to the referenced patents and other related developments, the split-cycle engine potentially offers many advantages in fuel efficiency, especially when integrated with an additional air or gas storage tank interconnected with the crossover passage, which makes it possible to operate the engine as an air hybrid engine. Relative to an electrical hybrid engine, an air hybrid engine can potentially offer as much, if not more, fuel economy benefits at much lower manufacturing and waste disposal costs.

To achieve the potential benefits, the air or air-fuel mixture in the crossover passage has to be maintained, for the entire four stroke cycle, at a predetermined firing condition pressure, e.g. approximately 18.6 bar (or 270 psi) per U.S. Pat. No. 6,543,225. The pressure may reach over 50 bar (735 psi) or higher, per U.S. Pat. No. 6,952,923, U.S. Pat. No. 6,986,329, a brochure entitled "Scuderi Air Hybrid Engine" distributed at SAE 2006 Congress by the Scuderi Group, LLC, and the May 2006 issue of European Automotive Design. Illustrated in graph 14 of FIG. 1 are, per US Patent Publication US2009/0038598-A 1, dynamic pressure profiles at the downstream end of the crossover passage and inside the power cylinder of a certain split-cycle engine. The ignition happens around 18 degrees ATDC (After Top Dead Center of the power cylinder). The crossover valve (XV) opens and closes at −5 degrees ATDC (or 5 degrees before TDC or BTDC) and 25 degrees ATDC, respectively, which presents a narrow opening window. Similarly tight timing is also presented in U.S. Pat. No. 6,952,923. Opening the crossover valve at or near TDC, when the power cylinder volume is at its minimum, helps reduce re-compression of the gas in the power cylinder and improves the efficiency. By opening several degrees before TDC, instead of exactly at or after TDC, it helps expand the valve opening window.

To seal against a persistently high pressure in the crossover passage, a practical crossover valve is most likely a poppet or disk valve with an outwardly (i.e. away from the power cylinder, instead of into it) opening motion as suggested in U.S. Pat. No. 4,170,970. Outward valve design is routinely implemented for applications with a high-pressure manifold, for example various compressor exhaust valves as illustrated in U.S. Pat. No. 4,253,805 and SAE Paper 2005-01-1884. In addition, outward opening design is desirable to deal with interference between an engine valve and the piston for any design with small combustion chamber as articulated in U.S. Pat. No. 6,952,923 (Column 14-Line 63 and Column 22-Line 33), especially when the compression ratio is greater than 80 to 1 as claimed by U.S. Pat. No. 6,952,923 (claim 3), which leaves practically no combustion chamber around TDC. Outward design is therefore further illustrated in figures in U.S. Pat. No. 4,170,970, No. 7,421,987 and No. 7,636,984 and in US Patent Applications 2008/0054205-A 1, 2009/0038598-A 1, 2009/0038599-A 1, 2009/0039300-A 1, 2009/0133648-A 1 and 2009/0044778-A 1.

When closed, the valve disk or head is pressured against the valve seat under the crossover passage pressure. To open the valve, an actuator has to provide a large opening force to overcome the pressure force on the valve head as well as the inertia. The opening pressure force is caused by the opening differential pressure dPo, which in FIG. 1 is about 35 bars. The differential pressure falls dramatically once the crossover valve opens because of a substantial pressure-equalization between the crossover passage and the power cylinder or a rapid rise in the power cylinder pressure. Similar trends in dynamic pressure profile and magnitude are found in U.S. Pat. No. 6,543,225. The pressure may reach over 50 bar (735 psi) or higher, per U.S. Pat. No. 6,952,923, U.S. Pat. No. 6,986,329, a brochure entitled "Scuderi Air Hybrid Engine" distributed at SAE 2006 Congress by the Scuderi Group, LLC, and the May 2006 issue of European Automotive Design.

For an engine valve, the flow area is approximately equal to the product of its perimeter and the valve lift. The opening force has to overcome, in addition to the spring preload if any, the pressure force that is equal to the differential pressure on the valve times the valve head area. The flow area and the opening pressure force are thus proportional to the diameter and the diameter to the second power, respectively. For higher power and better efficiency, it is a good practice to maximize the diameter or perimeter of intake valves, or crossover valves in split-cycle engines. This also entails two or more crossover valves to achieve reasonable total flow area while minimizing the pressure force. U.S. Pat. No. 6,952,923 discloses one design with four 13-mm crossover valves and another design with two 18.4-mm crossover valves, resulting in on each valve an opening force of 464 N and 931 N, respectively, under an opening differential pressure dPo of 35 bars. The opening differential pressure force in a conventional engine of the same volume displacement is typically 400 N for an exhaust valve and much lower for an intake valve. The design with four 13-mm crossover valves has a more tolerable opening force, but it adds too much structure complexity and cost penalty because of a large number of the valves involved. The design with two 18.4-mm crossover valves presents large opening force, challenging the corresponding valve actuator in areas of functional capability, durability, size, power consumption, etc. It is even a greater challenge if one desires lower flow resistance and thus larger valve diameter, considering that a conventional engine of the same volume displacement may have two 32-mm intake valves. A 32-mm crossover valve would have an opening force of 2815 N, challenging for any actuator, under a differential pressure of 35 bars.

Various efforts have been made to overcome the large opening force on a crossover valve. In U.S. Pat. No. 7,421,987 and US Patent Application 2008/0054205-A 1, one uses a combination of a spring bias force and a hydraulic force.

In U.S. Pat. No. 7,636,984 and US Patent Application 2009/0044778-A 1, one uses a pneumatic booster or pressure balance mechanism that entails at least one pneumatic chamber (in addition to or other than the crossover passage itself) or one pneumatic piston (in addition to or other than the crossover valve head itself) or both to counter the differential pressure.

In summary, a crossover valve actuator has to deal with large opening force while providing reasonable gas flow area.

SUMMARY OF THE INVENTION

Briefly stated, in one aspect of the invention, one preferred embodiment of the crossover valve system for a split-cycle engine having a power cylinder and a crossover passage comprises first and second crossover valves, each valve opening outwardly away from the power cylinder and providing fluid communication between the power cylinder and the crossover passage, with the diameter of the second crossover valve being larger than the diameter of the first crossover valve; and an actuation mechanism operative to open the first crossover valve, then the second crossover valve after a predetermined delay.

In operation, one is able to use a substantially smaller opening force to open, against a large initial differential pressure between the crossover passage and the power cylinder, the first crossover valve because of its smaller diameter and thus a smaller cross-section area. The second crossover valve, with a larger diameter and thus a larger cross-section area, opens also with a smaller opening force at a later time when the differential pressure between the crossover passage and the power cylinder has been substantially reduced because of the fluid flow through the first crossover valve.

In another embodiment, the actuation mechanism further includes a camshaft operably connected with first and second cams; the first cam operably drives the first crossover valve, and has a first-cam lobe extending from a first-crossover-valve open position to a first-crossover-valve close position for a first-crossover-valve duration; the second cam operably drives the second crossover valve, and has a second-cam lobe extending from a second-crossover-valve open position to a second-crossover-valve close position for a second-crossover-valve duration; and the second-crossover-valve open position has a predetermined delay relative to the first-crossover-valve open position, whereby providing time differential in the opening actions of the first and second crossover valves.

In another embodiment, the actuation mechanism further includes first and second valve actuators driving the first and second crossover valves, respectively, whereby providing independent actuation to the crossover valves. One is able to drive the first and second crossover valves using different lift profiles, including time delay feature, through a controller.

In another embodiment, the ratio of the diameter of the second crossover valve to the diameter of the first crossover valve is greater than 1.83, whereby achieving more than 50% force reduction.

In another embodiment, the first crossover valve opens between 10 degrees before the top-dead-center and 3 degrees before the top-dead-center; and the second crossover valve opens between 2 degrees before the top dead center and 7 degrees after the top dead center, when a substantial reduction in the differential pressure has been achieved because of the flow through the first crossover valve.

The present invention provides significant advantages over and/or supplemental benefits to the prevailing crossover valve systems or actuators, which use two crossover valves of the same diameter and the same opening timing and thus entail significant size or diameter needed for the valve perimeter-related flow capacity, resulting in a significant cross-section area and thus a large initial opening force. By adopting differentiation in valve diameter and opening timing for two, or if desired two groups of, crossover valves, the present invention is able to reduce the opening force at each of the two valves, without reduction in overall flow area or capacity. The smaller crossover valve opens first against a large initial differential pressure between the crossover passage and the power cylinder. Its opening force is smaller however because of its smaller cross-section area. The larger crossover valve opens later when the differential pressure is much reduced after filling the power cylinder for a certain period of time through the port of the smaller crossover valve, resulting in a smaller opening force even with a larger cross-section area. The opening force reduction via the present invention may be sufficient to resolve practical design issues associated with crossover valves, which present a great engineering challenge because of their exposure to a large differential pressure. At minimum, the opening force reduction via this invention will greatly help other engineering efforts to resolve this challenge.

The present invention, together with further objects and advantages, will be best understood by reference to the following detailed description taken in conjunction with the accompanying drawings.

DETAILED DESCRIPTION OF THE INVENTION

Figure 2:
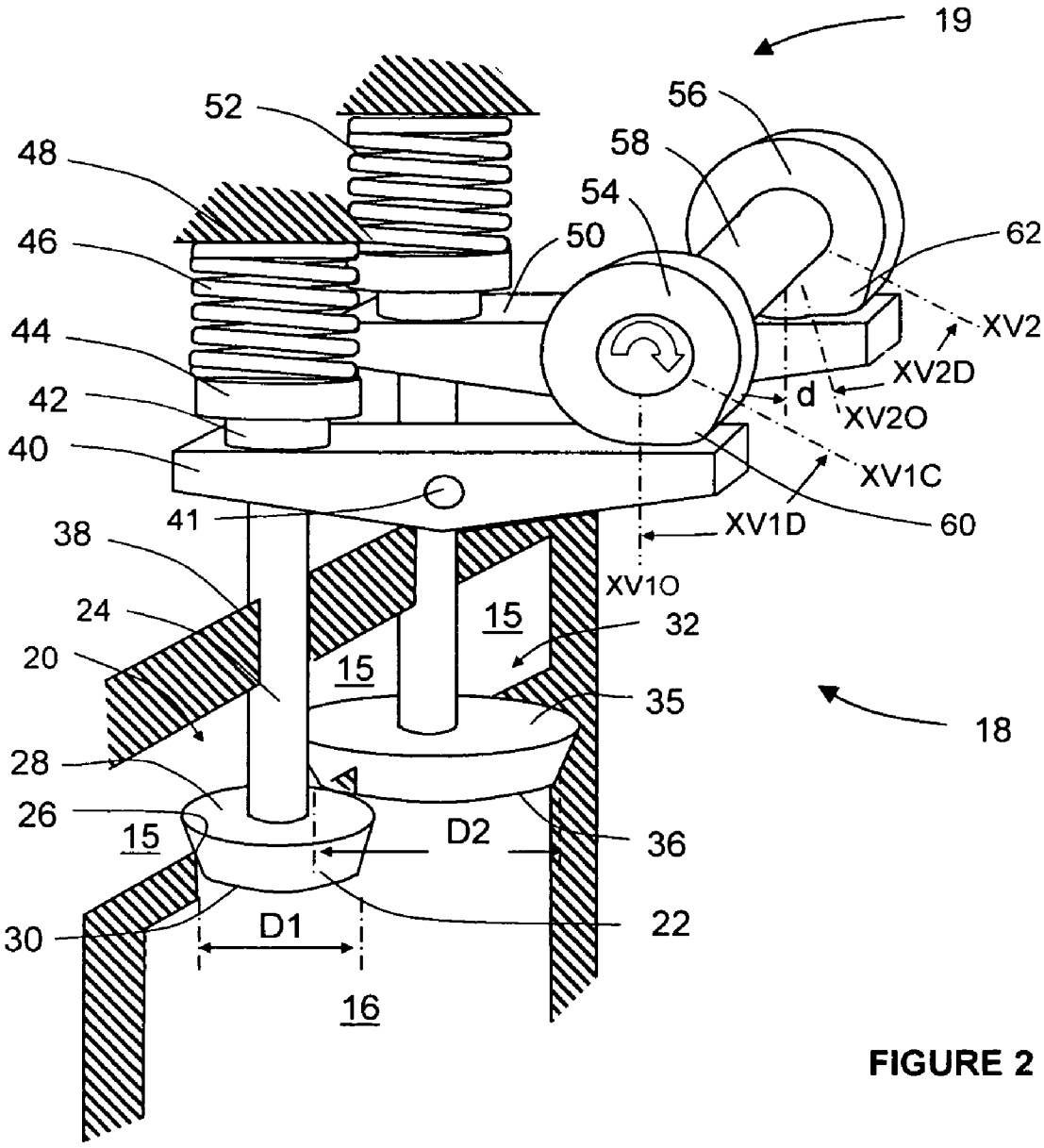
FIG. 2 is a schematic illustration of one preferred embodiment of the crossover valve system.

Referring now to FIG. 2, a preferred embodiment of the invention provides a crossover valve system 18. The system 18 comprises a first crossover valve 20 of a smaller diameter D1 and a second crossover valve 32 of a larger diameter D2.

The crossover valve system 18 is part of a split cycle engine, the entirety of which is not shown in FIG. 2, especially but not limited to those disclosed in U.S. Pat. No. 6,543,225, No. 6,952,923, and No. 6,986,329 and US Patent Applications 2009/0038598-A 1, 2009/0039300-A 1, and 2009/0044778-A 1. The split-cycle engine includes a crankshaft revolving about a crankshaft axis; at least one compression piston slideably received within a corresponding compression cylinder and operably connected to the crankshaft such that the compression piston reciprocates through an intake stroke and a compression stroke during a single rotation of the crankshaft or a thermodynamic cycle; at least one power piston slideably received within a corresponding power cylinder 16 and operably connected to the crankshaft such that the power piston reciprocates through an expansion or power stroke and an exhaust stroke during a single rotation of the crankshaft or a thermodynamic cycle; a crossover passage 15 interconnecting the compression cylinder and the power cylinder 16; one or more compression-cylinder intake valves supplying fresh gas into the compression cylinder; one or more power-cylinder exhaust valves dispelling exhaust gas out of the power cylinder; one or more crossover inlet valves providing gas flow communication between the compression cylinder and the crossover passage 15; and one or more crossover outlet valves, or simply called crossover valves in this application, providing gas flow communication between the crossover passage 15 and the power cylinder 16. With the first crossover valve 20 and the second crossover valve 32 in FIG. 2, it is possible to reduce the valve actuation force significantly, or to increase the gas flow area significantly, or both.

Although in its singular form of the noun, the crossover passage 15 may include more than one passage or distinguishable volume even for a single pair of the compression cylinder and power cylinder to achieve other functional advantages. For example, the crossover passage 15 may include two branches or conduits (not shown in FIG. 2), each of which connects one crossover valve 20 or 32 with its corresponding crossover inlet valve (not shown in FIG. 2) situated between the compression cylinder and the crossover passage, or at the inlet of the crossover passage. In an air hybrid application, the crossover passage is also connected with at least one air or gas storage system, not shown in FIG. 2.

The first crossover valve 20 includes a first-crossover-valve head 22 and a first-crossover-valve stem 24. The first-crossover-valve stem 24 is slideably supported by a first-crossover-valve guide 38. The first-crossover-valve head 22 includes a first-crossover-valve first surface 28 and a first-crossover-valve second surface 30, which are exposed to the crossover passage 15 and the power cylinder 16, respectively. When the first crossover valve 20 closes as shown in FIG. 2, the first-crossover-valve head 22 is in contact with a first-crossover-valve seat 26, sealing off the fluid communication between the crossover passage 15 and the power cylinder 16. The diameter D1 used in this application should be considered as that of the sealing line or contact line between the head 22 and the seat 26. The same convention applies to other engine valve diameters.

Other than its larger diameter D2, the second crossover valve 32 has essentially the same structure features as the first crossover valve 20 does. It includes a second-crossover-valve first surface 35 and a second-crossover-valve second surface 36 exposed to the crossover passage 15 and the power cylinder 16, respectively.

The two crossover valves 20 and 32 are actuated by an actuation mechanism 19 that includes a first valve spring 46, a second valve spring 52, and a camshaft 58 fitted with a first cam 54 and a second cam 56.

The first crossover valve 20 is operably connected with the first valve spring 46 through a first spring retainer 44 mounted at one end of the first-crossover-valve stem 24, distal to the first crossover valve 20. The first valve spring 46 is further constrained by a spring support 48, which is stationary relative to the engine structure. The first crossover valve 20 is operably connected with the first cam 54 through a first rocker arm 40 pivoting around a first pivot 41, and a first fitting 42 mounted next to the first spring retainer 44 on the first-crossover-valve stem 24. Optionally, the first spring retainer 44 and the first fitting 42 are integrated into a single structure element (not shown in FIG. 2). In a substantially the same way as shown in FIG. 2, the second crossover valve 32 is operably connected with the second valve spring 52 and the second cam 56.

The first cam 54 has a first-cam lobe 60 extending from the first-crossover-valve open (XV1O) position to the first-crossover-valve close (XV1C) position for a first-crossover-valve duration (XV1D). The second cam 56 has a second-cam lobe 62 extending from the second-crossover-valve open (XV2O) position to the second-crossover-valve close (XV2C) position for a second-crossover-valve duration (XV2D). The second-cam lobe 62 has a rotational or angular delay d relative to the first-cam lobe 60. In FIG. 2, the first-cam lobe 60 just comes into contact with the first rocker arm 40 at the first-crossover-valve open (XV1O) position, and the second-cam lobe 62 is still a clockwise delay d away from rotating into contact with a second rocker arm 50.

In operation, as the camshaft 58 and thus the first and second cams 54 and 56 rotate clockwise from the position shown in FIG. 2, the first-cam lobe 60 lifts up and opens the first crossover valve 20, via the first rocker arm 40 for a duration of XV1D. After a delay d from the position shown in FIG. 2, the second-cam lobe 62 lifts up and opens the second crossover valve 32 for a duration of XV2D. The crossover valves 20 and 32 do not have to close at the same time, i.e., their close positions XV1C and XV2C do not have to be identical in the angular or phase position.

Alternatively, the actuation mechanism 19 may adopt other forms of rocker arms not shown in FIG. 2, or no rocker arms at all, for example, using a direct acting design not shown in FIG. 2.

Figure 1:
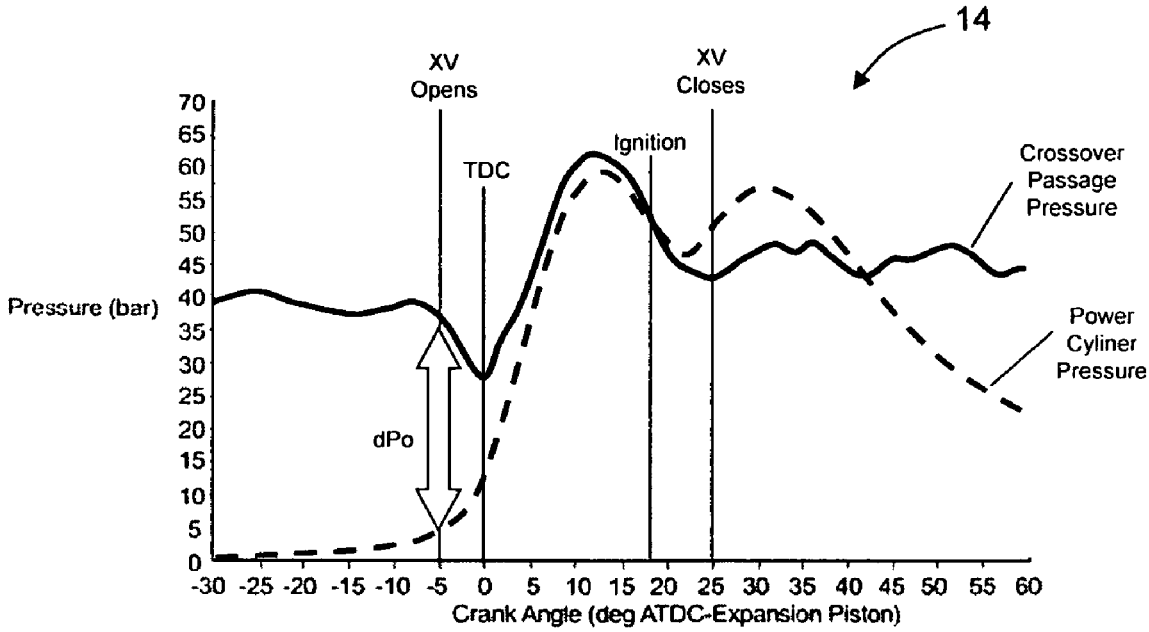
FIGURE 1 PRIOR ART
FIG. 1 is a graph showing prior art pressure profiles, and ignition and crossover valve timing per US Patent Application 2009/0038598-A 1.
Figure 3:
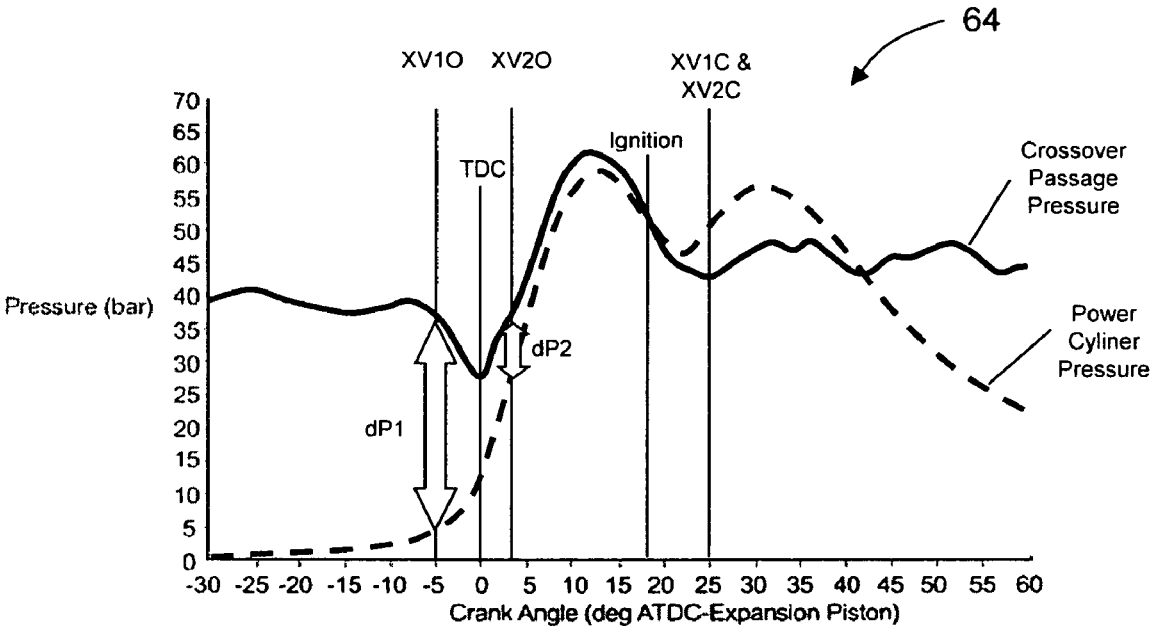
FIG. 3 is a graph showing two valve opening events per current invention.

Referring now to FIG. 3, a graph 64 features identical pressure profiles as the graph 14 does in FIG. 1. However, instead of only one valve opening event, involving likely two valves, and associated opening differential pressure dPo at a crank angle of −5 degrees in FIG. 1, the operation in FIG. 3 includes two valve opening events, with the first and second crossover valves opening at crank angles of −5 degrees ATDC (XV1O) and +3 degrees ATDC (XV2O), respectively. Their respective opening differential pressures are dP1 and dP2, with dP2 being much smaller than dP1. Both crossover valves close at the same crank angle of 25 degrees (XV1C and XV2C), which is not mandatory. The values of dP1 in FIG. 3 and dPo in FIG. 1 are generally equal, and the value or dP2 is likely to be more than what is depicted in FIG. 3 considering that only a small crossover valve opens between −5 degrees and +3 degrees, resulting in a slower pressure equalization. Nonetheless, the value of dP2 is still substantially smaller than that of dP1.

The valve opening positions XV1O and XV2O are not limited to −5 degrees ATDC and +3 degrees ATDC, respectively, shown in FIG. 3. In general, both XV1O and XV2O should be as close to TDC as possible for pumping efficiency; XV1O and XV2O should be sufficiently ahead of valve closing events XV1C and XV2C, respectively, for easier design of the actuation mechanism; and there should be enough delay between XV2O and XV1O to achieve necessary pressure rise in the power cylinder at XV2O. Considering all these and other factors, preferably, −10 degrees ATDC<XV1O<−3 degrees ATDC, and −2 degrees ATDC<XV2O<7 degrees ATDC. Expressed alternatively, XV1O is between 10 degrees BTDC and 3 degrees BTDC, and XV2O is between 2 degrees BTDC and 7 degrees ATDC.

As discussed in the Background of the Invention, the flow area and the opening force for an engine valve or disk valve are proportional to the diameter and the diameter to the second power, respectively. Let the baseline or prior art design have two crossover valves of the same diameter Do; let them open at the same time against the differential pressure dPo; let D1 and D2 the respective diameters of the first and second crossover valves of this invention; let the first and second crossover valves open against the differential pressures dP1 and dP2, respectively; then the opening pressure force on each of the prior art crossover valves, Fo, is estimated to be $$Fo=(3.14/4)*Do\hat{}2*dPo,$$

the opening pressure force on the first crossover valve 20, F1, is estimated to be $$F1=(3.14/4)*D1\hat{}2*dP1,$$

and the opening pressure force on the second crossover valve 32, F2, is estimated to be $$F2=(3.14/4)*D2\hat{}2*dP2.$$

If a force ratio Rf=F1/Fo, and let dP1=dPo, then $$Rf=F1/Fo=(D1/Do)\hat{}2 \quad (1)$$

That is the force ratio Rf is equal to the diameter ratio D1/Do to the second power. With Equation (1), one is able to estimate the pressure force reduction for a given reduction in the diameter of the first crossover valve 20 relative to that of the prior art crossover valve. For example, 30% and 50% reductions in diameter results in 50% and 75% reductions, respectively, in the pressure force on the first crossover valve, i.e., achieving Rf values of 0.5 and 0.25.

If, for example, the diameter Do of each of the two prior art crossover valves is equal to 18.4 mm as in U.S. Pat. No. 6,952,923, a 30% reduction in diameter results in a D1 of 12.9 mm and a reduction of the pressure force from a challenging 931 N to a much lower value of 466 N.

Let Lo the lift of the prior art crossover valve, and let L1 and L2 the lifts of the first and second crossover valves 20 and 32, respectively, then the flow area of each of the two prior art crossover valves, Afo, is estimated to be $$Afo=3.14*Do*Lo,$$

the flow area of the first crossover valve 20, Af1, is estimated to be $$Af1=3.14*D1*L1,$$

and the flow area of the second crossover valve 32, Af2, is estimated to be $$Af2=3.14*D2*L2.$$

If the total flow area remains the same or 2*Afo=Af1+Af2, and Lo=L1=L2, then $$2*Do=D1+D2,$$

assuming the opening delay d to have a limited value, and if further keeping dP1=dPo, then $$D2/D1=2/\mathrm{sqrt}(Rf)-1 \quad (2)$$

where the symbol sqrt means "square root of." Or $$D2/Do=2-\mathrm{sqrt}(Rf) \quad (3)$$

After achieving the desired force reduction on the first crossover valve by reducing D1 per Equation (1), one may use either Equation (2) or (3) to estimate necessary diameter D2 for the second crossover valve 32 to achieve the same total flow area.

Using the same example above and referencing parameters from U.S. Pat. No. 6,952,923, with a 30% reduction in D1 from 18.4 mm to 12.9 mm and a 50% reduction in F1 from 931 N to 466 N, one estimates D2/D1 to be 1.83 or D2/Do to be 1.3, which gives D2=24 mm.

For a general problem with a given set of design constraints, including the total flow area requirement, one obtains from Equation (2) that D2/D1 should be greater than 1.24 if one tries to achieve a significant force reduction, say greater than 20% reduction, i.e., Rf<0.8. Therefore, D2/D1 is preferably greater than 1.24 for more than 20% force reduction, and greater than 1.83 for more than 50% force reduction.

If let F2=F1, then $$dP2/dP1=(D1/D2)\hat{}2 \quad (4)$$

and if further with the total flow area remaining the same (i.e., 2*Afo=Af1+Af2), Lo=L1=L2, and dP1=dPo, then $$dP2/dP1=Rf/(2-\mathrm{sqrt}(Rf))\hat{}2 \quad (5)$$

After achieving force reduction and flow area guarantee earlier, Equation (4) or (5) provides the value of the differential pressure dP2 at or below which the second crossover valve 32 will experience no higher differential pressure force than the first crossover valve 20 does.

Again using the same example above and referencing parameters from U.S. Pat. No. 6,952,923, with D1=12.9 mm and D2=24 mm, or Rf=0.5, one derives dP2/dP1=0.3. If dP1=35 bar, then dP2=10.5 bar. As long as a 24-mm second crossover valve opens against a differential pressure dP2 at or less than 10.5 bar, it experiences a pressure force no higher than 466 N.

In the above example, the goal of the design exercise is to reduce the valve driving force. The same design principle can be used to increase flow area or reduce flow resistance. If the cam system is able to handle 931 N differential pressure force, then one may choose to have Rf=1, or D1=Do. If F2=F1=931 N, dP1=35 bar, and dP2=10.5 bar, then, per Equation (4), D2/D1=sqrt(35/10.5)=1.83. With D2=1.83*18.4=33.6 mm and (Af1+Af2)/(2*Afo)=(D2+D1)/(2*Do)=(33.6+18.4)/(2*18.4)=1.41, one is able to achieve roughly 41% increase in flow area, thus much less flow resistance and better efficiency for the engine.

Figure 4:
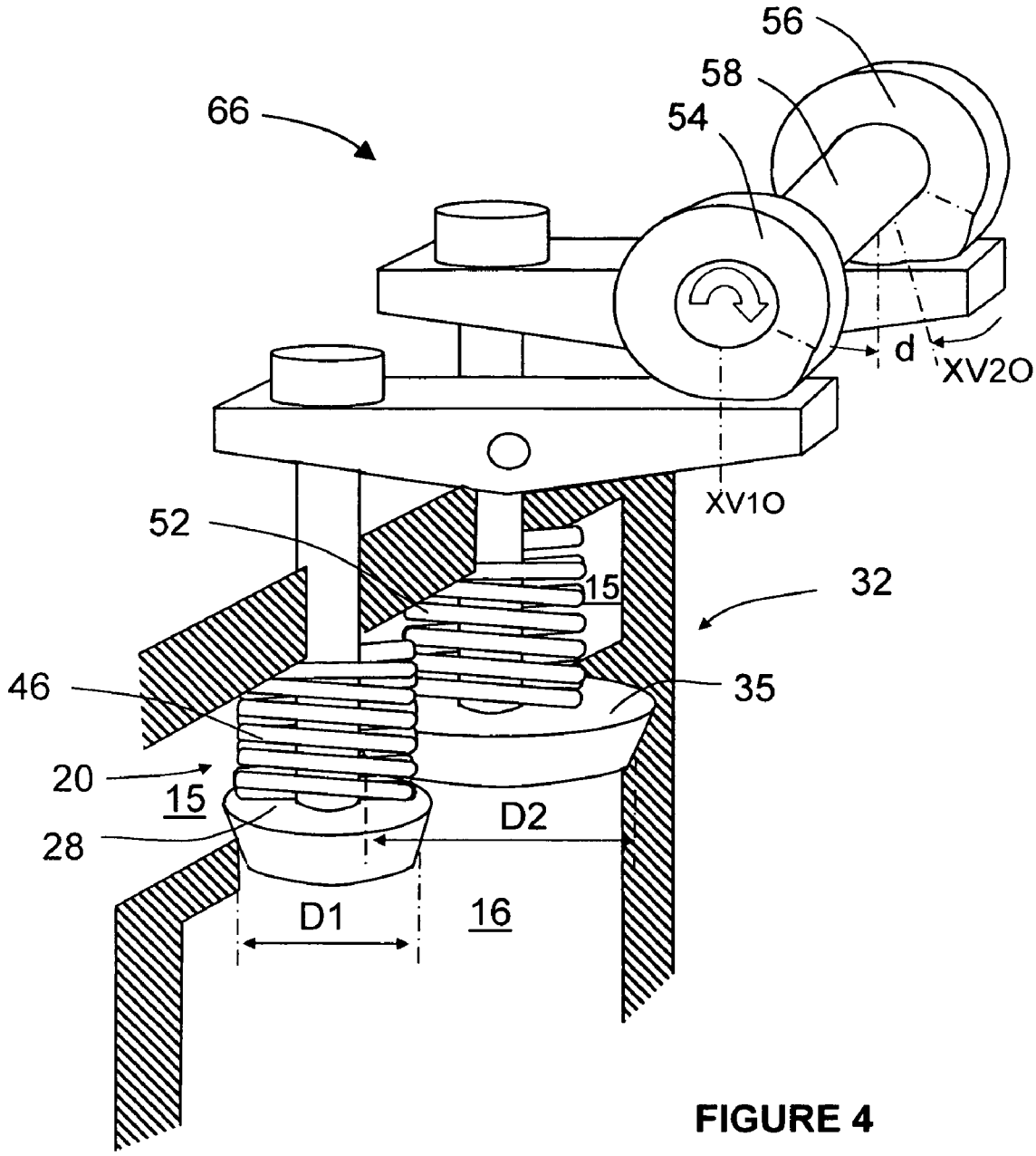
FIG. 4 is a schematic illustration of another preferred embodiment, featuring another way of placing the return springs.

FIG. 4 depicts an alternative embodiment of the invention that features some variation in the actuation mechanism 66. The valve springs 46 and 52 are relocated inside the crossover passage 15 and directly above and pressing the crossover valve first surfaces 28 and 35. This arrangement has the potential to reduce package size in vertical direction. The actuation mechanism 66 retains the ability to produce a delay d between the first and second cams 54 and 56, one key feature of the invention.

Figure 5:
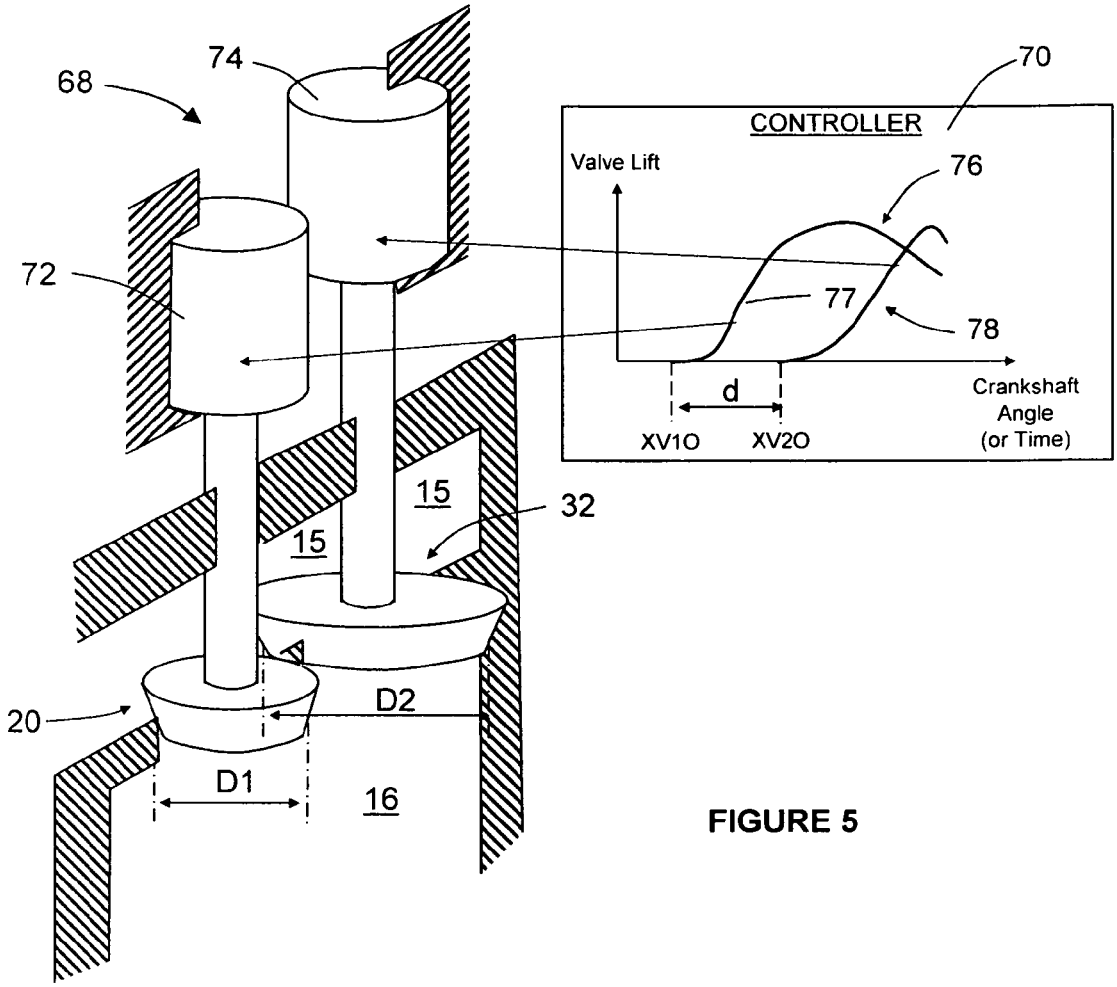
FIG. 5 is a schematic illustration of another preferred embodiment, featuring versatility of the actuation mechanism.

Refer now to FIG. 5, which is a drawing of yet another alternative embodiment of the invention. Its actuation mechanism 68 includes a controller 70 and first and second valve actuators 72 and 74. The first and second valve actuators 72 and 74 drive the first and second crossover valves 20 and 32, respectively. The controller 70 provides first and second lift profiles 76 and 78 for the first and second valve actuators 72 and 74, respectively. The lift profiles 76 and 78 can be either in crankshaft angle domain or in time domain. The first and second crossover valves 20 and 32 open at XV1O and XV2O, respectively, with XV2O being later than XV1O by a delay d. The opening points XV1O and XV2O are generally around TDC (not shown in FIG. 5). Preferably, −10 degrees ATDC<XV1O<−3 degrees ATDC, and −2 degrees ATDC<XV2O<7 degrees ATDC, with ATDC being "After TDC;" or XV1O is between 10 degrees BTDC and 3 degrees BTDC, and XV2O is between 2 degrees BTDC and 7 degrees ATDC, with BTDC being "Before TDC." One may purposely provide a steeper slope on the opening ramp 77 of the first lift profile, as depicted in FIG. 5, so that the first crossover valve 20 opens up faster, resulting in a faster filling and pressurization of the power cylinder 16 and thus more significant differential pressure reduction for easier opening of the second crossover valve 32.

The actuators 72 and 74 can be of a mechanical, electrical, fluid, magnetic, or piezoelectric type, or of a mixed type.

In an air hybrid application, the controller 70 controls the actuators 72 and 74 to keep the crossover valves 20 and 32 closed when the power cylinders are not to be activated, for example, during the regenerative braking mode. In this situation, the crossover valves should have no lift at all. Similarly in a cam-drive system as shown in FIGS. 2 and 4, a cam profile switch mechanism, not shown in FIGS. 2 and 4, can be integrated to run a flat profile so that the crossover valves 20 and 32 are kept closed during the regenerative braking mode. This switch mechanism can be of a mechanical, electrical, fluid, magnetic, or piezoelectric type, or of a mixed type. There are also various other control strategies for different modes of the air hybrid operation. Therefore, the lift profiles 76 and 78 in FIG. 5 and the cam lobe designs and valve events in FIGS. 2-4 should be understood as those only when there is a need to open the crossover valves 20 and 32 for the expansion and exhaust cycles, e.g., during the cruising mode of an air hybrid application.

In all the above descriptions, the first and second valve springs 46 and 52 are each identified or illustrated, for convenience, as a single mechanical coil spring. When needed for strength, durability or packaging, however each or any one of them may include a combination of two or more springs. In the case of mechanical coil springs, they can be nested concentrically, for example. They may also be pneumatic springs.

Also, in many illustrations and descriptions so far, the application of the invention is defaulted to be in crossover valve control, and it is not limited so. The invention can be applied to other situations where an outward valve experiences a large pressure in the associated manifold.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. A crossover valve system for a split-cycle engine having a power cylinder, a compression cylinder, and a crossover passage providing fluid communication between the power cylinder and the compression cylinder, the valve system comprising:

first and second crossover valves, each valve opening outwardly away from the power cylinder and into the crossover passage to provide fluid communication between the power cylinder and the crossover passage;

the diameter of the second crossover valve being larger than the diameter of the first crossover valve; and an actuation mechanism operative to open the first crossover valve then, after a predetermined delay, open the second crossover valve.

2. The crossover valve system of claim 1, wherein:

the actuation mechanism further includes a camshaft having first and second cams with lobes operative to open and close the first and second crossover valves.

3. The crossover valve system of claim 1, wherein the ratio of the diameter of the second crossover valve to the diameter of the first crossover valve is greater than 1.24.

4. The crossover valve system of claim 1, wherein the ratio of the diameter of the second crossover valve to the diameter of the first crossover valve is greater than 1.83.

5. The crossover valve system of claim 1, wherein the actuation mechanism is operative to open the first crossover valve between 10 degrees before top-dead-center (TDC) and 3 degrees before TDC, and open the second crossover valve between 2 degrees before TDC and 7 degrees after TDC.

6. The crossover valve system of claim 1, further comprising first and second valve springs situated inside the crossover passage and directly above the first and second crossover valves, respectively.

7. The crossover valve system of claim 1, wherein the first and second crossover valves close at the same time.

8. The crossover valve system of claim 1, wherein the first and second crossover valves close at separate times.

9. The crossover valve system of claim 1, wherein the crossover passage further comprises more than one passage.

10. The crossover valve system of claim 1, wherein the actuation mechanism comprises first and second valve actuators facilitating independent actuation of the valves.

11. The crossover valve system of claim 10, wherein the actuators are controlled by a controller providing first and second lift profiles for the first and second valves, respectively.

12. The crossover valve system of claim 10, wherein the actuators are electrically operated.

13. The crossover valve system of claim 10, wherein the actuators are operated through an electro-fluid means.

14. The crossover valve system of claim 10, wherein the actuators are electromagnetically operated.

15. The crossover valve system of claim 10, where the actuators are operated through a piezoelectric means.

* * * * *